US009030358B2

(12) United States Patent
Chou

(10) Patent No.: US 9,030,358 B2
(45) Date of Patent: May 12, 2015

(54) MINIATURE MULTI-FREQUENCY ANTENNA

(75) Inventor: Chih-Shen Chou, Jhunan Township, Miaoli County (TW)

(73) Assignee: Unictron Technologies Corporation, Hsin-Chu (TW)

( * ) Notice: Subject to any disclaimer, the term of this patent is extended or adjusted under 35 U.S.C. 154(b) by 369 days.

(21) Appl. No.: 12/888,163

(22) Filed: Sep. 22, 2010

(65) Prior Publication Data

US 2011/0095947 A1 Apr. 28, 2011

(30) Foreign Application Priority Data

Oct. 23, 2009 (TW) ..... 98219658 U

(51) Int. Cl.
*H01Q 1/38* (2006.01)
*H01Q 9/04* (2006.01)

(52) U.S. Cl.
CPC ..... *H01Q 9/0421* (2013.01); *H01Q 5/371* (2015.01)

(58) Field of Classification Search
USPC ..... 343/700 MS, 702
See application file for complete search history.

(56) References Cited

U.S. PATENT DOCUMENTS

| | | | | |
|---|---|---|---|---|
| 6,867,736 | B2 * | 3/2005 | Faraone et al. | 343/700 MS |
| 6,917,335 | B2 * | 7/2005 | Kadambi et al. | 343/700 MS |
| 7,012,568 | B2 * | 3/2006 | Desclos et al. | 343/700 MS |
| 7,012,570 | B2 * | 3/2006 | Chen et al. | 343/700 MS |
| 2002/0122007 | A1 * | 9/2002 | Jansen | 343/702 |
| 2007/0171131 | A1 * | 7/2007 | Sorvala et al. | 343/700 MS |
| 2008/0165063 | A1 * | 7/2008 | Schlub et al. | 343/702 |

* cited by examiner

*Primary Examiner* — Hoang V Nguyen
*Assistant Examiner* — Hai Tran
(74) *Attorney, Agent, or Firm* — Muncy, Geissler, Olds & Lowe, P.C.

(57) ABSTRACT

A miniature multi-frequency antenna, comprising at least one dielectric substrate, at least one signal electrode and at least one ground electrode. The signal electrode and the ground electrode are disposed on a substrate. The signal electrode contains at least two branches and at least one branch is partially overlapped with the ground electrode. Each interlayer region between the partially overlapped electrodes forms a specific capacitance. By utilizing this interlayer capacitive effect, the resonant frequency of lower frequency band is achieved while the size of the antenna is effectively reduced. For obtaining the resonant frequency of the high frequency bands, the design concept of PIFA is applied on other branches of the signal electrode. A miniature antenna thus obtained is capable of transmitting/receiving multi-frequency signals having the benefits of easily adjusting impedance and resonant frequency.

17 Claims, 16 Drawing Sheets

MINIATURE MULTI-FREQUENCY ANTENNA

BACKGROUND OF THE INVENTION

1. Field of the Invention

The present invention relates to an antenna, particularly to a miniature multi-frequency antenna, that is suitable for being utilized in small-sized communication devices and is capable of receiving and transmitting multi-frequency signals.

2. The Prior Arts

Nowadays, an antenna plays an important role in various wireless communication electronic devices. With the progress and development of Integrated Circuit (IC) technology, various electronic elements have been miniaturized. Thus, the trend for the development of wireless communication devices is toward light weight, thin profile and compact size while still providing various functions such as data processing, network connection, voice signals transmitting/receiving, audio/video signals broadcasting, etc. Therefore, it is preferred to have a small-sized antenna with the capability of transmitting and receiving multi-frequency signals.

In general, a Planar Inverted F Antenna (PIFA) or a Loop Antenna is a conventional choice to be frequently used in small-sized wireless communication devices. Both are widely utilized due to their simple construction, low cost, easy design, and small size. However, the PIFA is susceptible to the reactance effect of nearby dielectric materials (for example, human body) and results in the resonant frequency deviation of the antenna. Namely, any elements near the antenna might significant influence antennas' characteristics so that the signal transmitting/receiving efficiency of the antenna might be reduced. A Loop Antenna normally shows less susceptibility to its surrounding environment. However, it is usually capable of receiving signals of a single frequency only due to its relatively narrow bandwidth. In order to receive signals with more than two frequencies, a plurality of antennas must be integrated in a wireless communication electronic device that will enlarge the size of the antenna In view of the problems and shortcomings of the prior art, the present invention provides a miniature multi-frequency antenna for solving aforementioned problems.

SUMMARY OF THE INVENTION

The objective of the present invention is to provide a miniature multi-frequency antenna that is capable of transmitting and receiving signals at more than two frequency bands. For the lower frequency band, a plurality of electrodes partially overlapped each other to form at least one particular region with specific capacitance and to adjust a resonant frequency of the antenna. The size of the antenna is therefore reduced. For the higher frequency band, a PIFA design is utilized for achieving the other required resonant frequencies. By utilizing these two different design methodologies in one antenna, a miniature wide-band multi-frequency antenna with less mutual interference can be obtained.

The other objective of the present invention is to provide a miniature multi-frequency antenna that the resonant frequency and impedance characteristics can be varied by adjusting the shape, area, or spacing of the overlapped regions of the corresponding electrodes.

Another objective of the present invention is to provide a miniature multi-frequency antenna that can be integrated into a circuit board without preparing additional installation space within the wireless communication electronic device to reduce the size of the device.

In order to achieve the above-mentioned objectives, the present invention provides a miniature multi-frequency antenna, comprising at least one dielectric substrate, at least one signal electrode and at least one ground electrode. The signal electrode comprises at least two branches and is connected to at least a signal feed line. The ground electrode is partially overlapped with at least one branch of the signal electrode and is connected to the ground feed line of the wireless device.

The partially overlapped signal electrode and the ground electrode form an inter-electrode region having capacitive effect that will help to significantly reduce the antenna size. The capacitance of the inter-electrode region can be adjusted via varying the shape, area, or spacing of the overlapped electrodes of the branches of the signal electrode and the ground electrode to modify the lower resonant frequency and the impedance of the antenna. On the other hand, a designed PIFA is applied on the other branches of the signal electrode to satisfy the resonance requirement and is easy to adjust impedance and higher resonant frequency of the antenna. By combining the abovementioned design concepts, the interference between different frequency bands can be minimized. The adjustment of the resonant frequencies and impedances of antennas for each band is much easier because there are relatively less interactions between these antennas. This is not attainable in the conventional multi-frequency antenna designed using PIFA or monopole in which significant interaction is inevitable. Therefore, the complexity of adjusting antenna characteristics can be decreased through the application of the present invention, resulting in the reduction of lead-time of customization and product development. Moreover, as the size of antenna is reduced, the dimension of the electronic device can be reduced leading to lower fabrication cost.

Furthermore, due to simplicity of its structure, the miniature multi-frequency antenna in the present invention can be realized diversely, is suitable for mass production, and can be manufactured integrally with the circuit board manufacturing process.

Further scope of the applicability of the present invention will become apparent from the detailed description given hereinafter. However, it should be understood that the description and specific examples, while indicating preferred embodiments of the present invention, are given by way of illustration only since various changes and modifications within the spirit and scope of the present invention will become apparent to those skilled in the art from these detailed description.

BRIEF DESCRIPTION OF THE DRAWINGS

The drawings in connection with the detailed description of the present invention are described briefly as follows, in which:

FIG. 1(*b*) is a perspective view of a miniature multi-frequency antenna according to a first embodiment of the present invention;

FIG. 4(*b*) is a bottom view of a miniature multi-frequency antenna according to the third embodiment of the present invention;

FIG. 5(*b*) is a bottom view of a miniature multi-frequency antenna according to the fourth embodiment of the present invention, wherein dashed lines indicate the ground electrode;

FIG. 12(*b*) is the measured insertion loss of the miniature dual band antenna as shown in FIG. 12(*a*).

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1A:
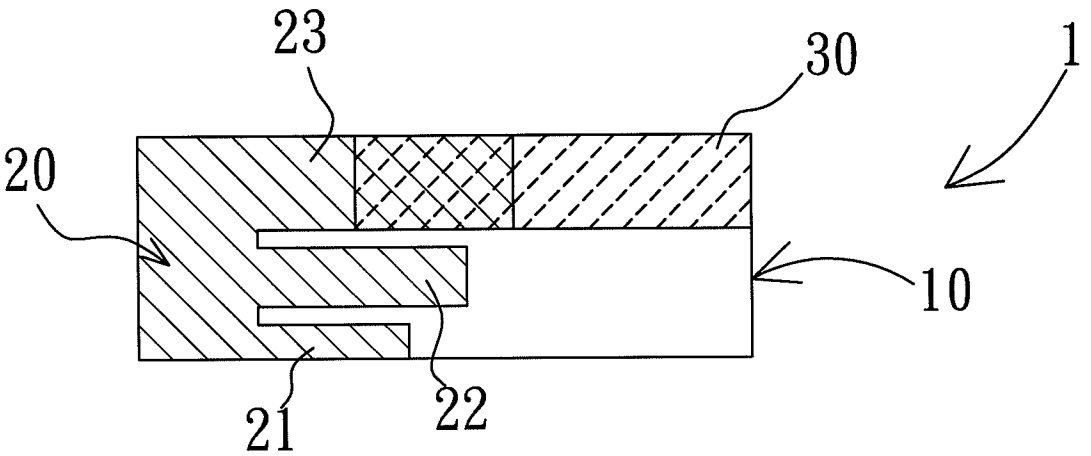
FIG. 1(*a*) is a top perspective view of a miniature multi-frequency antenna according to a first embodiment of the present invention.
Figure 1B:
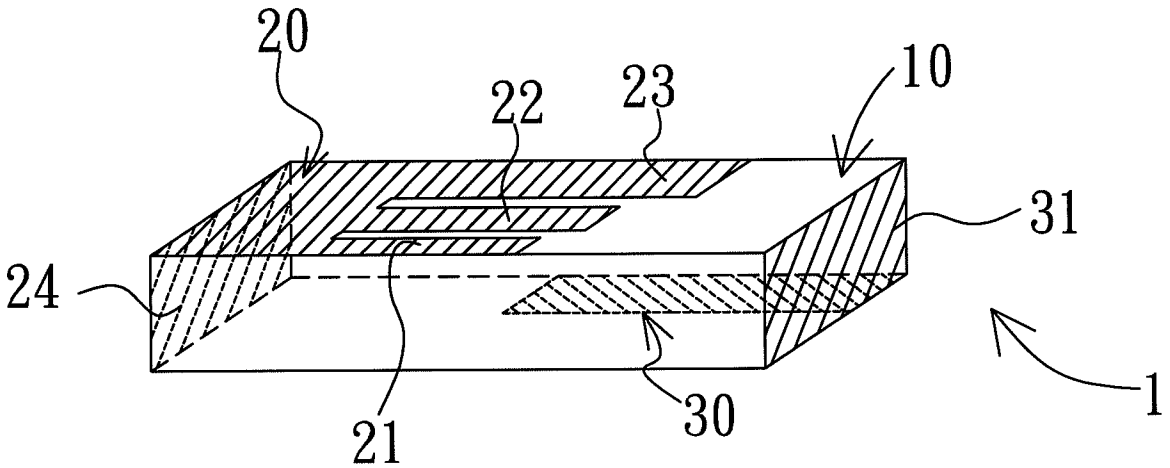

Refer to FIG. 1(*a*) and FIG. 1(*b*) for a top and a perspective view of a miniature multi-frequency antenna according to a first embodiment of the present invention. In the following mentioned embodiments, identical number will be used for similar element. As shown in FIG. 1(*a*) and FIG. 1(*b*), a miniature multi-frequency antenna 1, comprises a substrate 10; a signal electrode 20 and a ground electrode 30. The substrate 10 has a top surface, a bottom surface and two end surfaces. The signal electrode 20 has three branches 21, 22, and 23, is disposed on the top surface of the substrate 10 and connects with a first terminal electrode 24 that is mounted on one end surface of the substrate 10. The ground electrode 30 is disposed on the bottom surface of the substrate 10, with its width roughly as same as that of branch 23 and is located below and connects with a second terminal electrode 31 that is mounted on the other end surface of substrate 10. As shown in FIG. 1(*a*), the ground electrode 30 is partially overlapped with the branch 23 of the signal electrode 20 to form an inter-layered region that has a function of a capacitor.

The substrate 10 is made of a dielectric material. The dielectric material is selected form a group comprises a ceramic material, a glass material, a magnetic material, a polymeric material and a composite of the abovementioned. The signal electrode 20 and the ground electrode 30 are made of conductive materials. The conductive material is selected form a group comprises Au, Ag, Cu, Sn and a non-metallic conductive materials.

Figure 2:
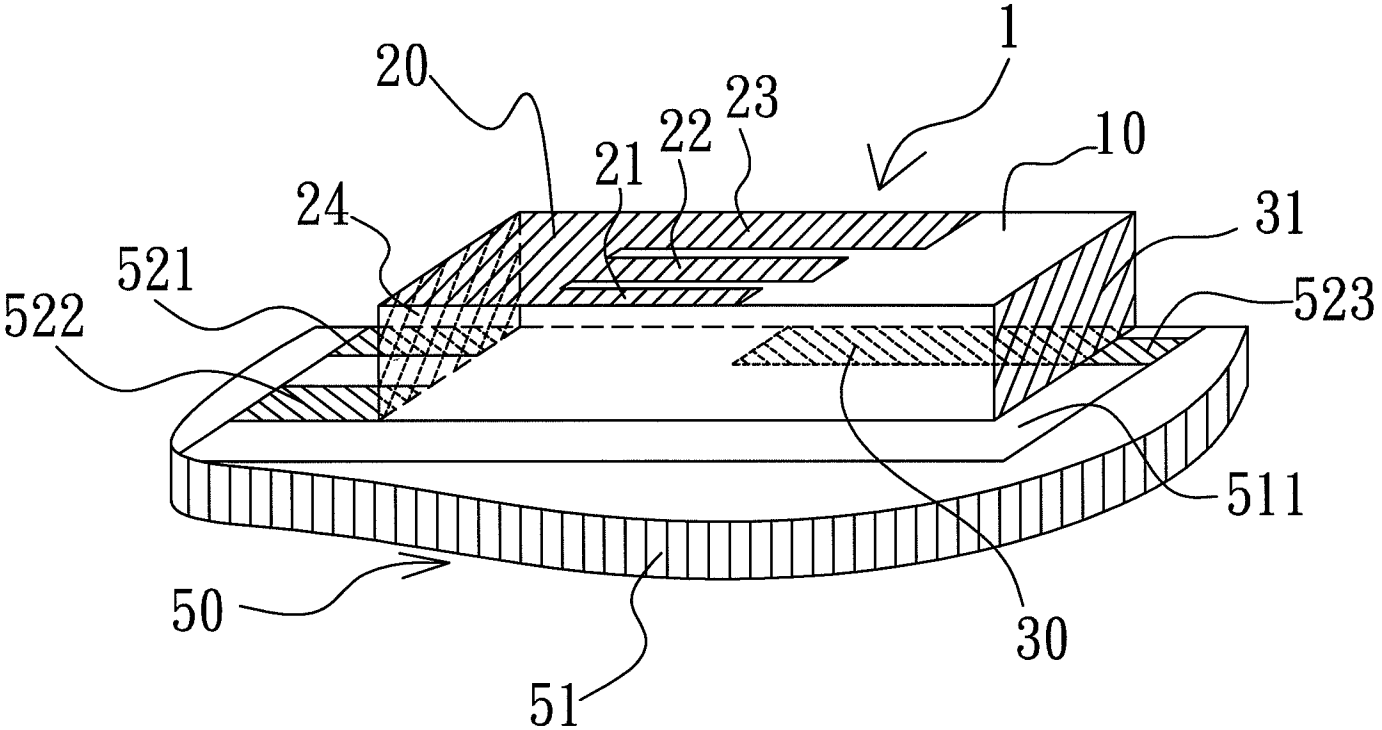
FIG. 2 is a perspective view illustrating one application of the miniature multi-frequency antenna shown in FIG. 1 according to the first embodiment of the present invention.

In communication devices, the signal electrode of the miniature multi-frequency antenna is connected to a signal feed line and the ground electrode is connected to a ground plane or a ground line to transmit/receive signals. Refer to FIG. 2, the miniature multi-frequency antenna 1 according to a first embodiment of the present invention is integrated in a circuit board 50. The circuit board 50 comprises a substrate 51 and a circuit (not shown). The substrate 51 has a ground clearance region 511 reserved on it. The miniature multi-frequency antenna 1 is disposed within the ground clearance 511 for avoiding the interference arising from the nearby electronic elements of the circuit. The circuit comprises a signal feed line 521, a first ground line 522 and a second ground line 523. The signal feed line 521 and the first ground line 522 extend on the clearance region 511 and connect to the first terminal electrode 24 and subsequently to the signal electrode 20. The second ground line 523 also extends on the clearance region 511 and connects to the second terminal electrode 31 and the ground electrode 30.

The miniature multi-frequency antenna 1 of the present invention is capable of providing signal transmission and receiving through connecting to the signal feed line 521 and the first and second ground lines 522 and 523. From basic theory of antenna design, the structure of the branches 21 and 22 of the signal electrode 20 are similar as a planar inverted F-antenna (PIFA). The structure of branch 23 of the signal electrode 20 and the corresponding partially overlapped ground electrode 30 is similar to that of a loop Antenna. The inter-layered region with capacitive effect is formed between the overlapped branch 23 of the signal electrode 20 and the ground electrode 30. With this increase in capacitance, area of the electrodes 20 and 30 can be reduced, leading further to the reduction in dimension of the substrate 10 accordingly. Through the structural design mentioned above, the structure akin to a loop antenna formed by the branch 23 and the ground electrode 30 can yields one resonant frequency, while the structure akin to PIFA antennas formed by the branches 21 and 22 can yield two different resonant frequencies, respectively. Therefore, the antenna of this embodiment can operate at three frequencies, namely, it is a tri-frequency antenna. With a small volume, the antenna is capable of transmitting and receiving multi-frequency signals in a stable manner. Further, the resonant frequencies, impedances, and other antenna characteristics can be tuned by changing either the length, width, geometric shape of signal electrodes and ground electrodes or changing the size and distribution of the inter-layered region between the electrodes 20 and 30.

Figure 3:
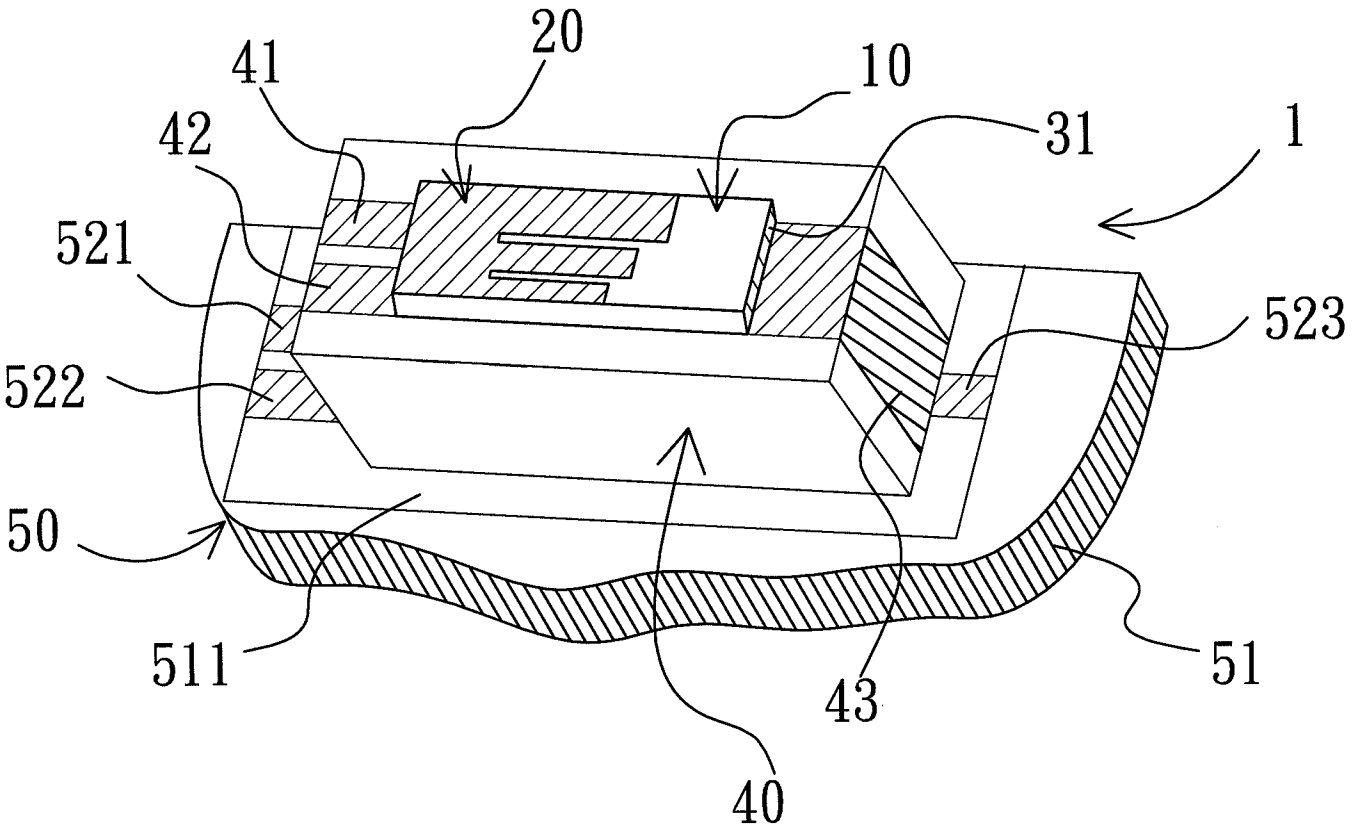
FIG. 3 is a schematic diagram of the structure of a miniature multi-frequency antenna according to a second embodiment of the present invention.

When the miniature antenna 1 is very close to the ground plane or to other electronic elements (less than 4 mm) due to harsh installation requirement of the wireless communication devices, the ground plane or other electronic elements will cause interference to the antenna. In order to avoid such interference that decline the signal quality, the distance of electrodes 20 and 30 to the ground plane must be increased. Reference with FIG. 3, a second embodiment of the present invention is shown. The major difference between the miniature multi-frequency antenna 1 of the second embodiment and that of the first embodiment is the first embodiment further comprises a carrier substrate 40 that is disposed between the substrate 10 and the circuit board 50. With this incorporation, the substrate 10 is raised as a whole and the distance of electrodes 20 and 30 to the ground plane is increased, thereby the influence of ground plane is decreased. The carrier substrate 40 is made of a dielectric material, such as a ceramic material, a glass material, a magnetic material, a polymeric material or a combination of the abovementioned. The carrier substrate 40 comprises a first connection electrode 41, a second connection electrode 42 and a third connection electrode 43. The first connection electrode 41 connects to the first terminal electrode 24 of the signal electrode 20 and the signal feed line 521 of the circuit board 50. The second connection electrode 42 connects to the first terminal electrode 24 of the signal electrode 20 and the first ground line 522. The third connection electrode 43 connects to the second terminal electrode 31 and the second ground line 523.

The substrate 10, the signal electrode 20 and the ground electrode 30 of the second embodiment are deployed the same as those of the first embodiment; and the connective electrodes on the carrier substrate 40 are arranged according to the status of the signal feed line 521 and ground lines 522 and 523.

The structure mentioned above is the fundamental form in conformity with the spirit of designing the miniature multi-frequency antenna 1 of the present invention. Any similar implement of deploying opposing signal electrode and ground electrode on the dielectric substrate, the signal electrode having two or more than two branches, one branch partially overlaps with the ground electrode to form the interlayered region that functions as a capacitor, is in conformity and is within the scope of the present invention. The shape, area, size, and spacing of the electrode can be adjusted to modify the signal transmitting/receiving characteristics of the antenna. Those skilled in the art will recognize that the present invention can be practiced with various modifications and changes and all such modifications are intended to be included within the scope of present invention.

The following embodiments are examples for illustrating the structural diversity of the present invention. It is to be understood, however, that the present invention is not limited to these embodiments. In a third embodiment, the antenna is integrated with a double layer printed circuit board (PCB). In a fourth embodiment, the antenna is integrated with a multilayer printed circuit board. In fifth and a sixth embodiments, the signal transmitting/receiving characteristics is adjusted via changing the shape, area and dimension of the electrode; and the seventh embodiment illustrates a manner for mass production and installation.

Figure 4A:
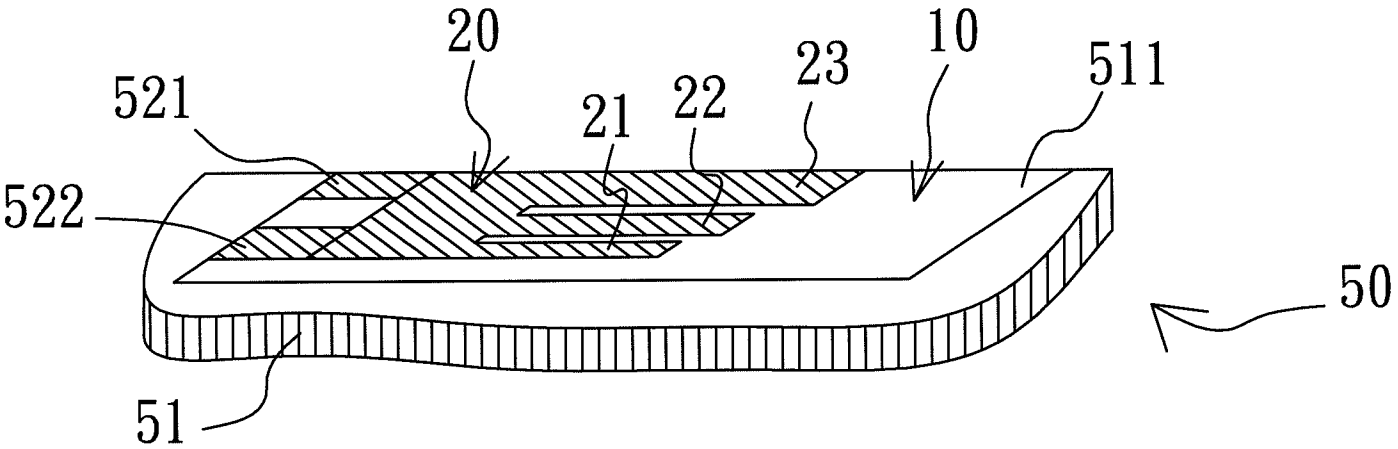
FIG. 4(*a*) is a top view of a miniature multi-frequency antenna according to a third embodiment of the present invention.
Figure 4B:
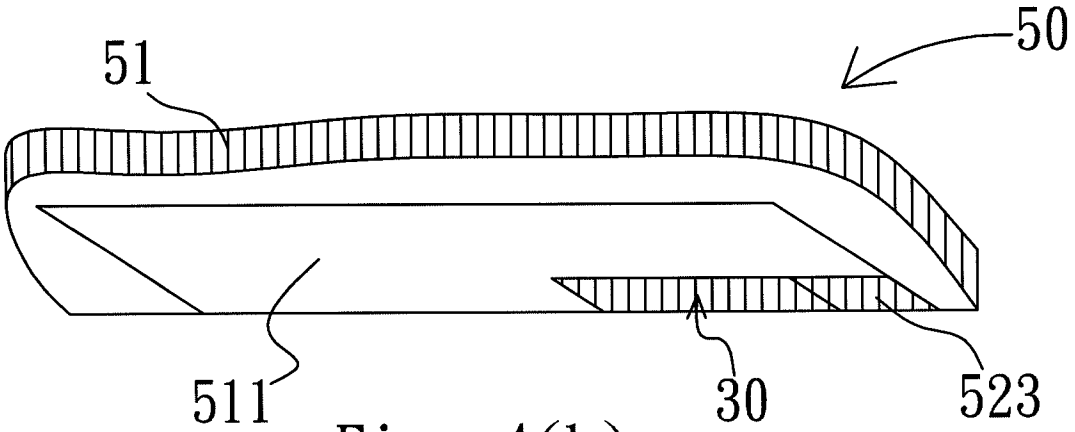

Refer to FIG. 4(*a*) and FIG. 4(*b*) for a top and a bottom view, respectively, of a miniature multi-frequency antenna according to a third embodiment of the present invention. The circuit board 50 is formed of substrate 51 and a circuit (not shown) that is arranged on the substrate 51. The circuit board 50 comprises a clearance region 511 without deploying the circuit on substrate 51. In this embodiment, the clearance region 511 of the circuit board 50 is utilized as a substrate 10. While forming circuit on the circuit board 50, a signal electrode 20 and a ground electrode 30 are formed, respectively, on the top and bottom surface of the substrate 51 by utilizing electroplating, thick film process, thin film process, or by adhering conductive sheets. With this kind of arrangement, the volume occupied by antenna 1 becomes indiscernible, thus not only overcomes the shortcomings of the prior art but also reduces the number of manufacturing processes required in integrating the antenna 1 and the circuit board 50 thereby saving material cost and production expense.

Figure 5A:
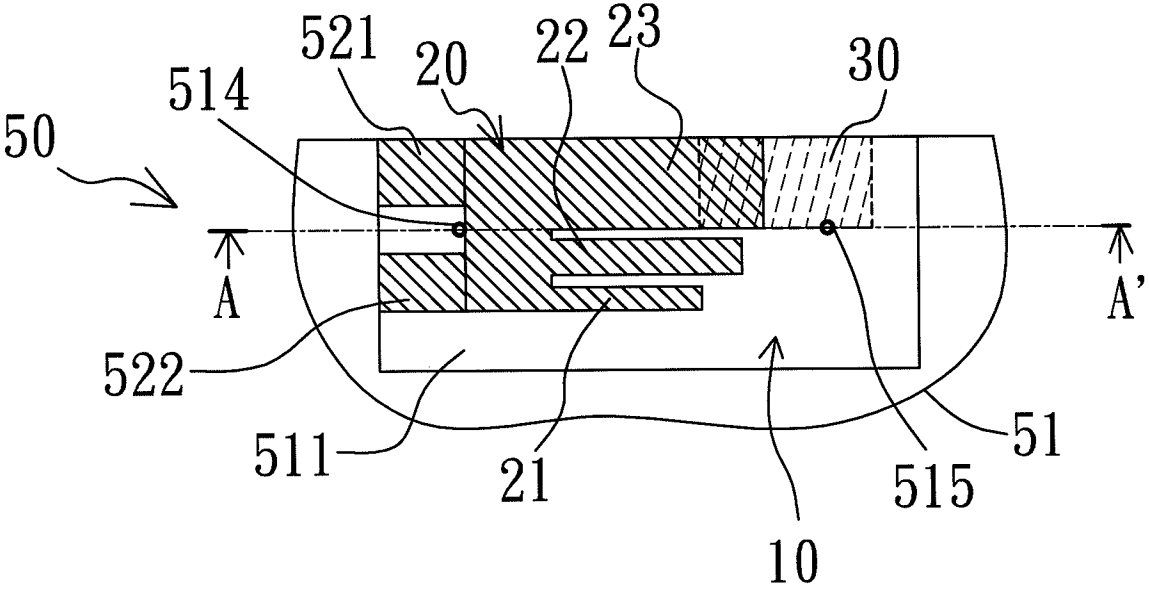
FIG. 5(*a*) is a top view of a miniature multi-frequency antenna according to a fourth embodiment of the present invention, wherein dashed lines indicate the ground electrode.
Figure 5B:
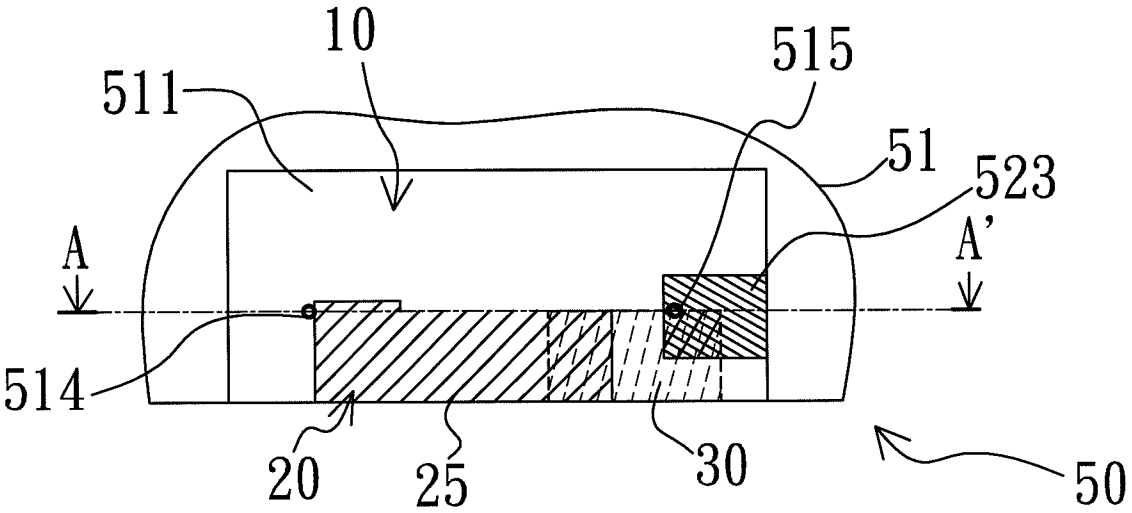
Figure 6:
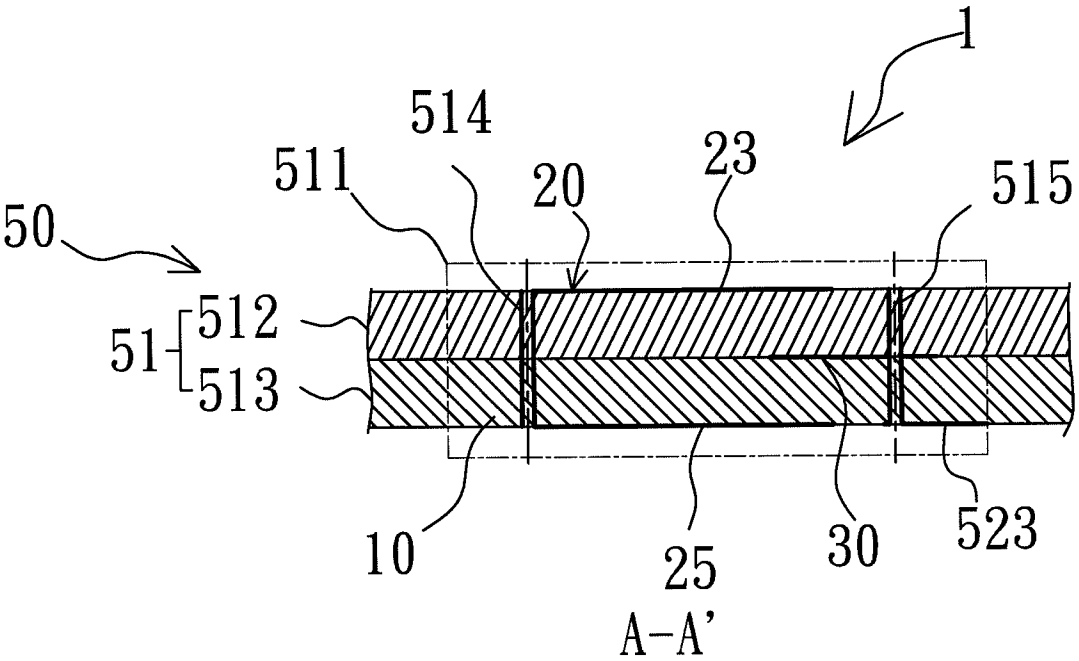
FIG. 6 is a cross section view along A-A' line of FIG. 5(*a*) and FIG. 5(*b*) according to the fourth embodiment of the present invention.

Refer further to FIGS. 5(*a*), 5(*b*) and 6 for a top, a bottom and a cross section view along A-A' line in FIG. 5(*a*) and FIG. 5(*b*) of a miniature multi-frequency antenna according to a fourth embodiment of the present invention. This embodiment is deployed by integrating antenna with a multilayer printed circuit board. As shown in FIG. 6, the substrate 51 of the circuit board 50 is a multilayered structure has multiple stacked substrate units 512 and 513. A clearance region 511 without disposing circuits, ground plane or any other electronic components, is reserved on the circuit board 50 when deploying circuits on the substrate 51. Two conductive through holes 514 and 515 are separated by a pre-determined distance and are provided in the clearance region 511 of the substrate 51 for connecting circuits on various layers. The miniature multi-frequency antenna 1 in this embodiment also utilizes the clearance region 511 of the substrate 51 as substrate 10. As such, along with the steps of manufacturing circuits onto the circuit board 50, the following elements are formed simultaneously through utilizing electroplating, thick film process, thin film process, or by adhering conductive sheets: the branches 21, 22, and 23 of the signal electrode 20 and the signal feed line 521, and the first ground line 522 formed on the top surface of the substrate 51; branch 25 of the signal electrode 20 and the second ground wire 523 formed on the bottom surface of the substrate 51, such that the branches 21, 22, and 23 of the signal electrode 20 are connected to the signal feed line 521 and to the first ground line 522, and are further connected to branch 25 via conductive through hole 514. In addition, as shown in FIG. 6, a ground electrode 30 connects to the second ground line 523 via conductive through hole 515, is formed between substrate units 512 and 513 and also between the branches of 23 and 25 of the signal electrode 20. Two capacitive regions are formed in between signal electrode 23 and ground electrode 30 as well as signal electrode 25 and ground electrode 30, respectively. Thus, a miniature multi-frequency antenna 1 is realized according to the essence and spirit of the present invention. Alternatively, the antenna can be realized also by deploying two ground electrodes on the top and bottom surfaces of the substrate with signal electrodes being formed between substrate units.

From the above description, it can be inferred that the number of electrodes disposed in multilayer circuit board configuration can be increased along with the increase in the number of substrate units. The number of signal feed lines and ground wires needed can be either increased or decreased depending on actual requirements without any limitation. Moreover, the signal electrode and the ground electrode are not necessarily required to be disposed on the top and bottom surfaces of a substrate. So long as a plurality of signal electrodes and a plurality of ground electrodes are disposed between a plurality of substrate units or on their surfaces in an alternating manner while retaining their relative spatial positions as mentioned above as well as keeping the necessary electrical connections with the circuits on the circuit boards, the required antenna functions can be achieved. Furthermore, the electrical connection configuration using through holes as mentioned above, while being used as an explanation only, is just one of the many available connection manners between layers of a circuit board. Various means for establish electrical connections between circuits on different layers are well known to those skilled in the art and thus shall not be further elaborated here. The present invention is not limited to the types of connections between layers and the ways the connections are formed.

Figure 7:
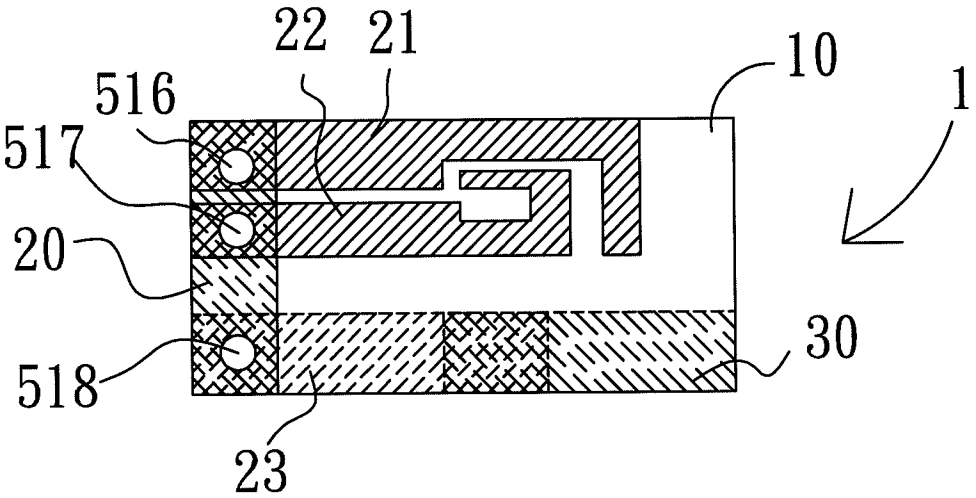
FIG. 7 is a top perspective view of a miniature multi-frequency antenna according to a fifth embodiment of the present invention.
Figure 8:
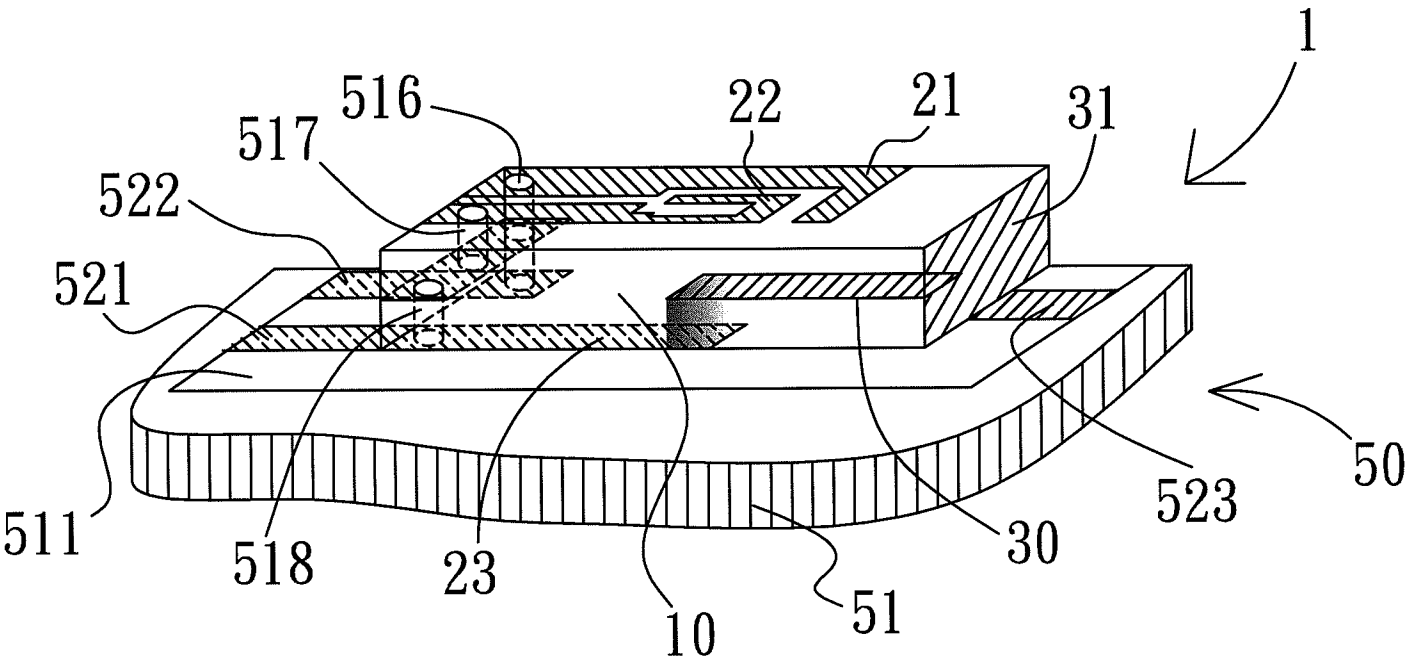
FIG. 8 is a schematic diagram of a miniature multi-frequency antenna according to the fifth embodiment of the present invention.

Subsequently, refer to FIG. 7 and FIG. 8 for a top and a perspective view of a miniature multi-frequency antenna according to a fifth embodiment of the present invention. The structure of antenna of the fifth embodiment is similar to that of the fourth embodiment with substrate 10 adopting the configuration of a multi-layer circuit board. The branches 21 and 22 of signal electrode 20 are formed on the top surface of substrate 10 and branch 23 is formed on the bottom surface. Branches 21, 22, and 23 are connected electrically through via holes 516, 517, and 518 respectively and are connected then to a signal feed line 521 and to a first ground line 522 of the circuit board 50. Therefore there is no need for installing a first terminal electrode. The conductive via 516 is of a through hole type while 517 and 518 are of blind via hole type; thus further illustrates that the present invention is unconfined to the types of electrical connections between layers and how the connections are formed. Moreover, the L-shape branch 21 is mounted around the outer rim of a hook-shape branch 22. As such, the resonant frequency and impedance of the antenna can be adjusted through change of the shape and size of the branches, i.e., the required specific characteristics of the antenna can be achieved by varying the size and/or shape of the various branches. Furthermore, a ground electrode 30 has a portion of it overlapping with a portion of branch 23 and is disposed on an intermediate layer in substrate 10, is connected outward to a second ground line 523 of circuit board 50 through a second terminal electrode 31, thereby to form a inter-layered region with capacitance functions. As the structure of this portion is similar to that mentioned above, no elaboration will be given again.

Figure 9:
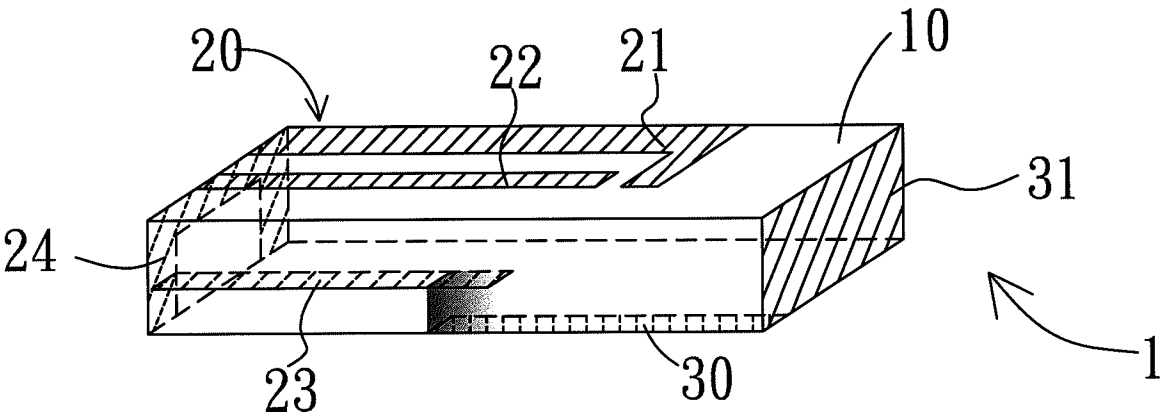
FIG. 9 is a perspective view of a miniature multi-frequency antenna according to a sixth embodiment of the present invention.

Refer to FIG. 9 for an antenna structure according to a sixth embodiment of the present invention illustrating variation in location, shape and dimension of electrodes. As shown in FIG. 9, the first terminal electrode 24 of antenna 1 is disposed on one end surface of substrate 10, is formed into a II shape. The branch 23 of the signal electrode 20 is located on an intermediate layer of substrate 10, and the ground electrode 30 is formed on the bottom surface of the substrate 10. The characteristics of the antenna 1 are adjusted through changing the shape of terminal electrode 24. In other words, terminal electrodes 24 and 31 are part of the signal electrode 20 and of ground electrode 30, respectively. Therefore, the characteristics of antenna can be adjusted either by varying the location, shape, size, or spacing of the branch electrode 21, 22, and 23 and the ground electrode 30 or by varying the shape, size, location of the terminal electrodes 24 and 31.

Figure 10:
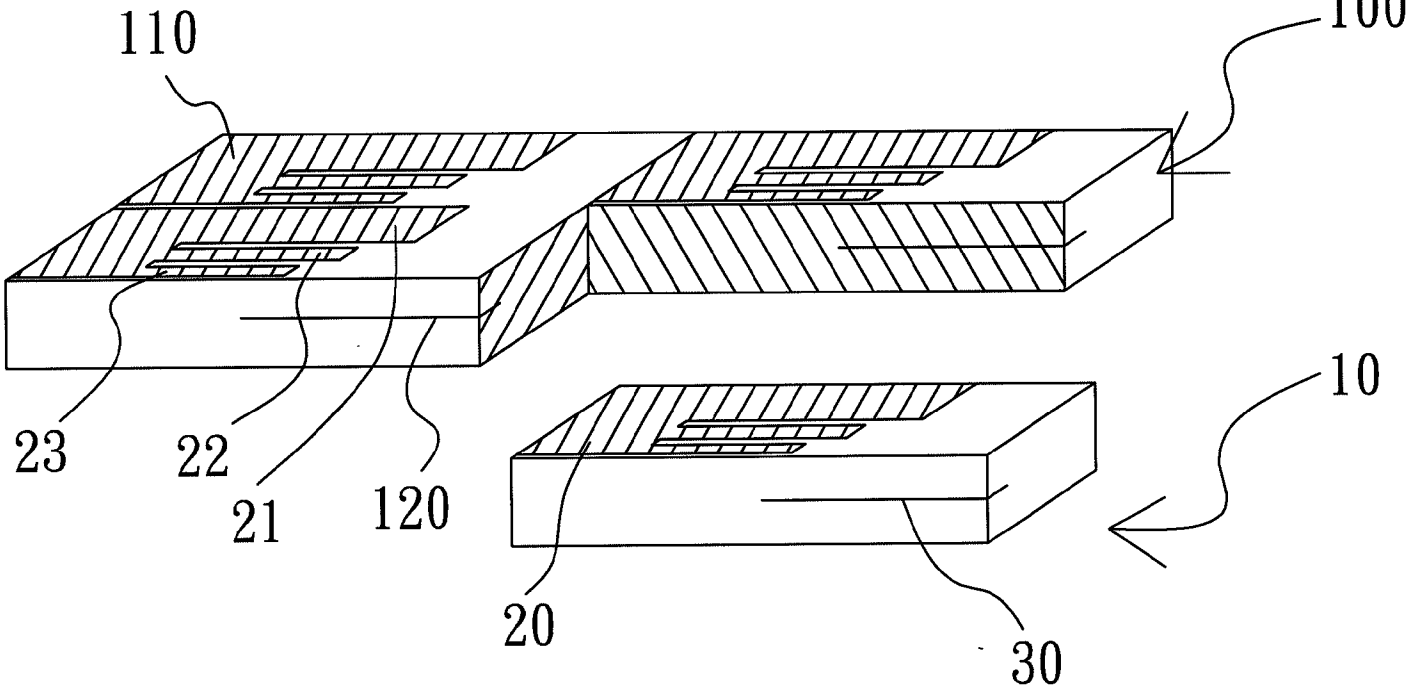
FIG. 10 is a schematic diagram of a miniature multi-frequency antenna mass-produced with circuit board manufacturing processes according to a seventh embodiment of the present invention.

Further refer to FIG. 10 for a schematic diagram of a miniature multi-frequency antenna in mass production according to a seventh embodiment of the present invention. The present invention though can be realized diversely, does not affect its capability of being mass produced due to simplicity of its structure. As shown in FIG. 10, using a multi-layer circuit board as a substrate 100, a plurality of signal electrodes 110, each has a set of branches 21, 22 and 23 separated by a pre-determined distance according the pre-designed pattern, are formed on the upper surface of the substrate 100. With respect to the signal electrodes 110, a plurality of ground electrodes 120 have a portion of its area overlapped with the branch 23 of the signal electrode 110, are formed on the intermediate layers of the substrate 100. Partition the substrate 100 according to the characteristics of the antenna required, one can obtain a large number of substrates 10 that are of the same structure each has a signal electrode 20 on its upper surface and a ground electrode 30 on the intermediate layer of substrate 10. As such, a great reduction in manufacturing cost and time can be achieved by producing a large quantity of semi-finished antenna products. As mentioned earlier, this is just one way of implementing mass production of the miniature multi-frequency antenna. Miniature multi-frequency antennas with various characteristics through the variations of the number, location, shape, size of the signal electrode and ground electrode can be mass produced in the same manner.

Figure 11:
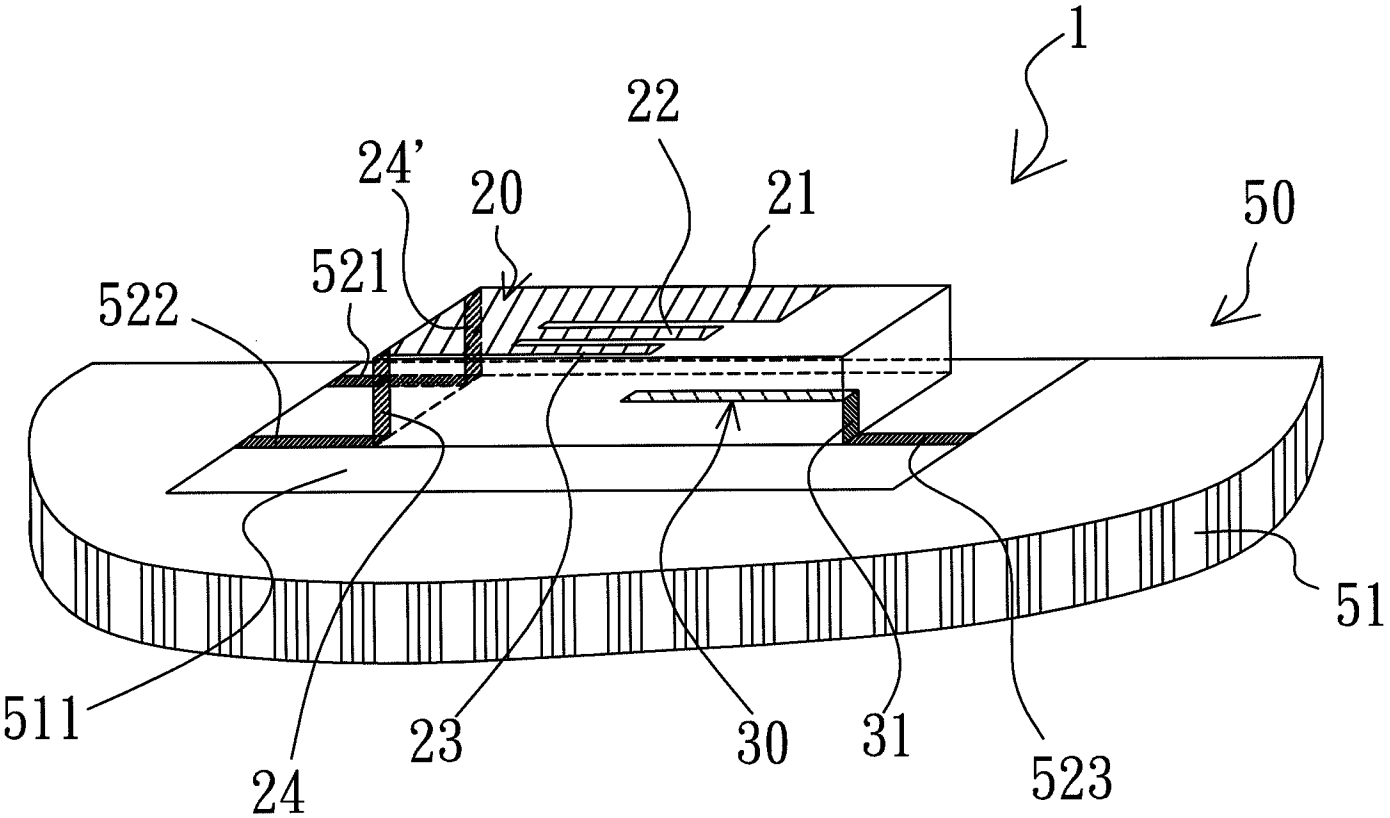
FIG. 11 is a schematic diagram of one application of a miniature multi-frequency antenna according to the seventh embodiment of the present invention.

As shown in FIG. 11, by disposing the substrate 10 on a clearance region 511 of a circuit board 50, and by forming terminal electrodes 24, 24' and 31 for establishing the connection with the signal feed line 521 and the ground line 522 and 523 of the printed circuit board 50 for transmitting/receiving signal, the miniature multi-frequency antenna 1 of the present invention is thus realized.

Figure 12A:
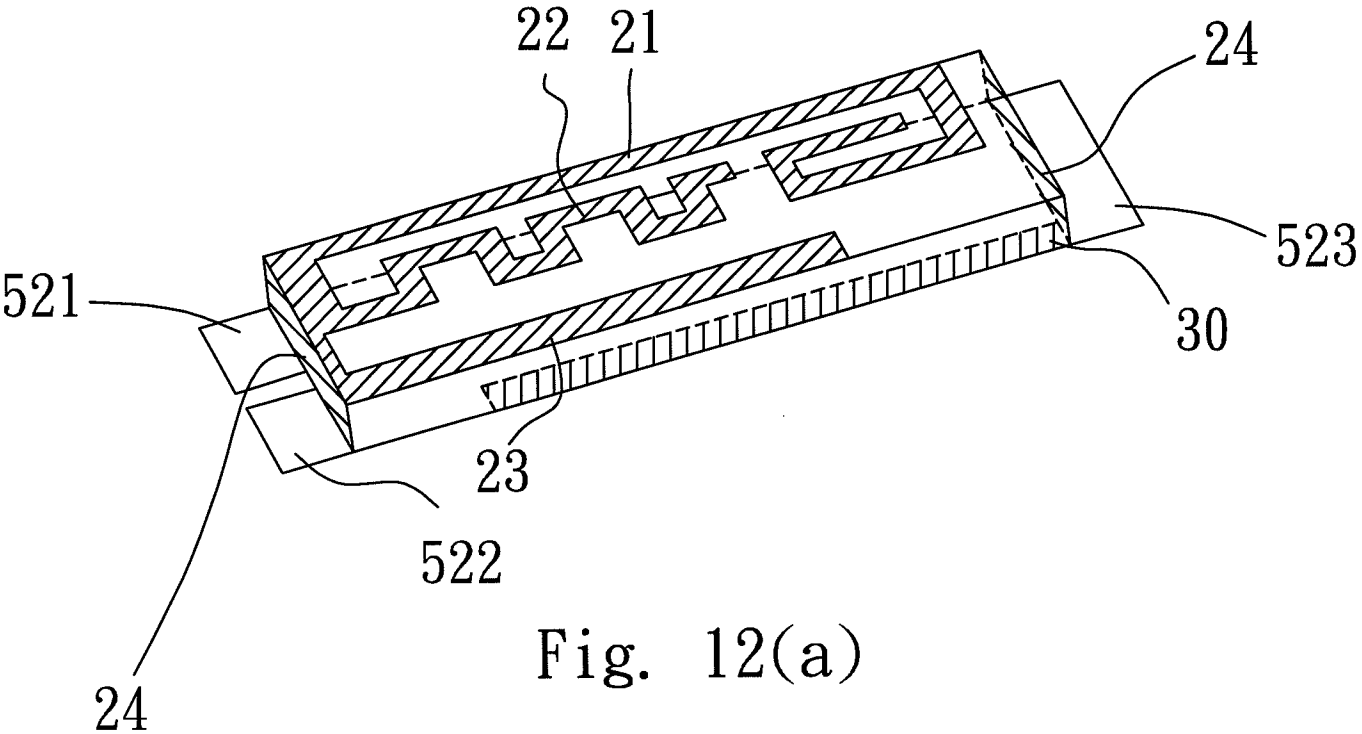
FIG. 12(*a*) is a perspective diagram of a miniature dual band antenna according to a eighth embodiment of the present invention.
Figure 12B:
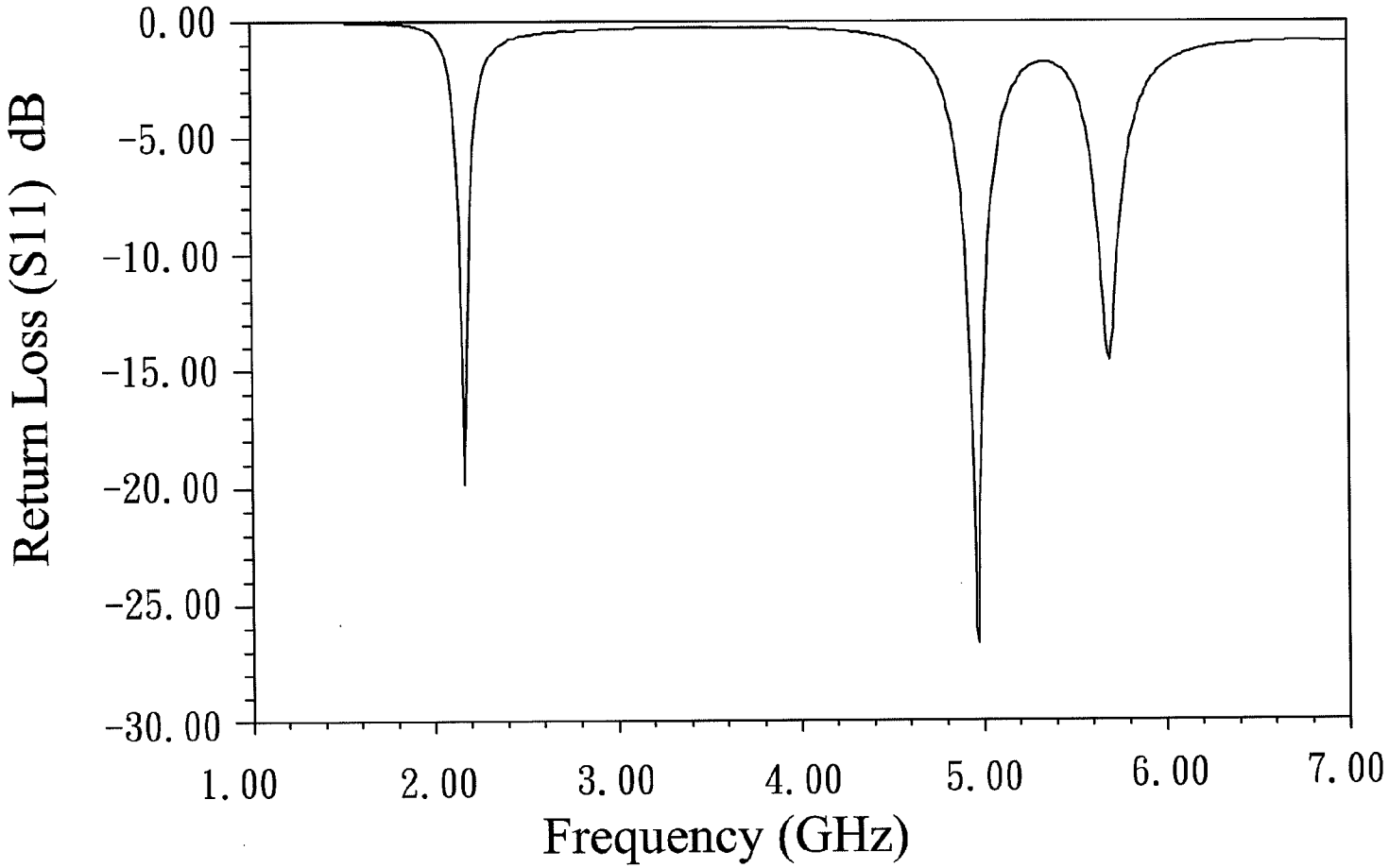

Further refer to FIG. 12(*a*) for a perspective view of a miniature multi-frequency antenna according to a eighth embodiment of the present invention. As the structure of this embodiment of the present invention is similar to that mentioned above, no elaboration will be given again. The return loss in dB of this triple-frequency antenna is illustrated in FIG. 12(*b*). As can be observed from the return loss result, well-matching of the antenna at frequency bands of 2.1~2.2GHz, 4.9~5.0GHz, and 5.65~5.75GHz can be obtained, respectively. It is clear that this miniature antenna can have good transmitting/receiving capability in multi-frequency bands.

In summary, the miniature multi-frequency antenna of the present invention, being deployed with a special design of the signal electrode and having its branches overlapped with the ground electrode, is capable of transmitting/receiving multi-frequency signals. The inter-layered region of the substrate between the partially overlapped signal and ground electrodes forms a region that possesses capacitive effect. Utilizing this antenna structure with capacitive region, the dimension of the antenna can be effectively reduced. Resonant frequencies, impedances and other antenna characteristics can be easily adjusted by changing the thickness of the substrate, the location, shape, dimension of the branches of the electrodes or by changing the size, shape, spacing of the overlapping region of the signal and ground electrodes. While being capable of implementing in various diversified ways, the miniature multi-frequency antenna of the present invention is also suitable for mass production or being incorporated simultaneously into the manufacturing process of printed circuit board due to its simple structure. Therefore, the miniature antennas disclosed in the present invention are capable of transmitting and receiving multi-frequency signals with the advantages of small size, low cost, high radiation efficiency and are suitable for mass production.

In the foregoing description, specific embodiments of the present invention have been given for an illustrative purpose. Those skilled in the art will recognize that a wide variety of modifications, alterations, and combinations can be made with respect to the above described embodiments without departing from the spirit and scope of the present invention. Thus, such modifications, alterations, and combinations are to be viewed as being within the ambit of the inventive concept and are to be included within the scope of present invention.

What is claimed is:

1. A miniature multi-frequency antenna which is capable of transmitting and receiving radio frequency signals and is electrically connected to at least one signal feed line and at least one ground line, comprising:

at least one dielectric substrate with a first planar surface and a second planar surface, wherein said first planar surface is opposite to said second planar surface;

at least one signal electrode, disposed on said first planar surface of said substrate and electrically connected to said signal feed line, wherein said signal electrode comprises at least one first branch and at least one second branch, said first branch and said second branch are interconnected with each other, and said first branch and said second branch are disposed coplanarly on the same surface of said first planar surface of said substrate; and at least one ground electrode, disposed on said second planar surface of said substrate and electrically connected to said ground line, wherein said ground electrode is shaped to be partially overlapped with said first branch of said signal electrode wherein said ground electrode and said signal electrode do not have electrical connection such that at least one capacitor is established in between said signal electrode and said ground electrode; said first branch of said signal electrode, said ground electrode together with said capacitor form at least one loop antenna having at least one first resonant frequency; and said second branch of said signal electrode which does not overlap with said ground electrode form at least one planar-inverted-F antenna having at least one second resonant frequency, wherein the first resonant frequency is lower than the second resonant frequency.

2. The miniature multi-frequency antenna as claimed in claim 1, wherein said signal electrode is electrically connected with said signal feed line and said ground line.

3. The miniature multi-frequency antenna as claimed in claim 1, wherein said substrate with said multi-frequency antenna built thereon is disposed within a ground clearance region of a circuit board; said ground clearance region is a reserved region in said circuit board where only said signal feed line and said ground line are disposed for signal receiving and transmitting; and said signal feed line and said ground line are electrically connected to said multi-frequency antenna through at least two terminal electrodes respectively disposed on different sides of said substrate.

4. The miniature multi-frequency antenna as claimed in claim 3, further comprising a carrier disposed between said substrate and said ground clearance region of said circuit board, wherein said carrier has at least two connection electrodes disposed for respectively connecting said signal electrode to said signal feed line and said ground electrode to said ground line.

5. The miniature multi-frequency antenna as claimed in claim 3, wherein said terminal electrodes are established as through holes or through vias inside said substrate for electrical connections of said antenna with said signal feed line and said ground line.

6. The miniature multi-frequency antenna as claimed in claim 1, wherein said substrate comprises a plurality of board units; said signal electrode and said ground electrode are disposed between said board units or on surfaces of said substrate; and said signal electrode and said ground electrode are separated by a spacing of at least one thickness of said board unit.

7. The miniature multi-frequency antenna as claimed in claim 6, wherein a plurality of said signal electrodes are disposed between said board units or on surfaces of said substrate.

8. The miniature multi-frequency antenna as claimed in claim 7, wherein said substrate further comprises at least one through hole or through via penetrating through said board units or said substrate to electrically connect said signal electrodes to said signal feed line.

9. The miniature multi-frequency antenna as claimed in claim 6, wherein a plurality of said ground electrodes are disposed between said board units or on surfaces of said substrate.

10. The miniature multi-frequency antenna as claimed in claim 9, wherein said substrate further comprises at least one through hole or through via penetrating through said board units or said substrate to electrically connect said ground electrodes to said ground line.

11. A miniature multi-frequency antenna which is capable of transmitting and receiving radio frequency signals and is electrically connected to at least one signal feed line and at least one ground line, comprising:

at least one dielectric substrate with a first planar surface and a second planar surface, wherein said first planar surface is opposite to said second planar surface; said substrate is disposed within a ground clearance region of a circuit board such that top and bottom surfaces of said ground clearance region are respectively said first planar surface and said second planar surface of said substrate; and said ground clearance region is a reserved region in said circuit board where only said signal feed line and said ground line are disposed for signal receiving and transmitting and at least two sides of the ground clearance region are surrounded by ground plane of the circuit board;

at least one signal electrode, disposed on said first planar surface of said substrate and electrically connected to said signal feed line, wherein said signal electrode comprises at least one first branch and at least one second branch, said first branch and said second branch are interconnected with each other and said first branch and said second branch are disposed coplanarly on the same surface of said first planar surface of said substrate; and at least one ground electrode, disposed on said second planar surface of said substrate and electrically connected to said ground line, wherein said ground electrode is shaped to be partially overlapped with said first branch of said signal electrode wherein said ground electrode and said signal electrode do not have electrical connection such that at least one capacitor is established in between said signal electrode and said ground electrode; said first branch of said signal electrode, said ground electrode together with said capacitor form at least one loop antenna having at least one first resonant frequency; and said at least one second branch of said signal electrode which does not overlap with said ground electrode form at least one planar-inverted-F antenna having at least one second resonant frequency, wherein the first resonant frequency is lower than the second resonant frequency.

12. The miniature multi-frequency antenna as claimed in claim 11, wherein said circuit board comprises a plurality of board units; said signal electrode and said ground electrode are disposed between said board units or on surfaces of said circuit board; and said signal electrode and said ground electrode are separated by a spacing of at least one thickness of said board unit.

13. The miniature multi-frequency antenna as claimed in claim 12, wherein a plurality of said signal electrodes are disposed between said board units or on surfaces of said circuit board.

14. The miniature multi-frequency antenna as claimed in claim 13, wherein said circuit board further comprises at least one through hole or through via penetrating through said board units or circuit board to electrically connect said signal electrodes to said signal feed line.

15. The miniature multi-frequency antenna as claimed in claim 12, wherein a plurality of said ground electrodes are disposed between said board units or on surfaces of said circuit board.

16. The miniature multi-frequency antenna as claimed in claim 15, wherein said circuit board further comprises at least one through hole or through via penetrating through said board units or circuit board to electrically connect said ground electrodes to said ground line.

17. The miniature multi-frequency antenna as claimed in claim 11, wherein said signal electrode is electrically connected with said signal feed line and with said ground line.

* * * * *